US007748652B2

(12) United States Patent
Musso et al.

(10) Patent No.: US 7,748,652 B2
(45) **Date of Patent: *Jul. 6, 2010**

(54) ELECTRIC HOPPER-SPREADER

(75) Inventors: Charles S. Musso, Hammondsport, NY (US); Tom Musso, Bath, NY (US)

(73) Assignee: Air-Flo Manufacturing Co., Inc., Prattsburgh, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/002,266

(22) Filed: Dec. 14, 2007

(65) Prior Publication Data

US 2008/0093485 A1 Apr. 24, 2008

Related U.S. Application Data

(63) Continuation of application No. 11/425,267, filed on Jun. 20, 2006.

(51) Int. Cl.
*B05B 3/00* (2006.01)

(52) U.S. Cl. ..... 239/722

(58) Field of Classification Search ..... 239/722, 239/650–689

See application file for complete search history.

(56) References Cited

U.S. PATENT DOCUMENTS 3,395,866 A 8/1968 Sousek et al.
3,583,645 A * 6/1971 Murray et al. ..... 239/657
3,727,801 A * 4/1973 Caridis et al. ..... 222/196
3,790,090 A 2/1974 Lorenc et al
3,871,588 A 3/1975 Long et al.
3,929,292 A 12/1975 Philips
4,212,428 A 7/1980 Walker
4,253,612 A 3/1981 Schulze
4,373,668 A * 2/1983 Forbes et al. ..... 239/74
4,469,210 A 9/1984 Blumer et al.
4,522,341 A 6/1985 Wall et al.
4,662,511 A 5/1987 Greener
5,842,649 A * 12/1998 Beck et al. ..... 239/677
5,947,391 A 9/1999 Beck et al.
6,209,808 B1 4/2001 Anderson
6,220,531 B1 4/2001 Pierce et al.
6,220,532 B1 4/2001 Manon et al.
6,398,137 B1 6/2002 Manon et al.
6,517,281 B1 2/2003 Rissi
6,698,997 B2 3/2004 Arne et al.
7,066,413 B2 * 6/2006 Musso et al. ..... 239/722

* cited by examiner

*Primary Examiner*—Davis Hwu
(74) *Attorney, Agent, or Firm*—Alix, Yale & Ristas, LLP

(57) ABSTRACT

A material spreading drive system for a hopper spreader having a conveyor and a spreader separately driven by two electric motors that are powered directly from the electrical system of the vehicle. The conveyor drive system includes a speed reducing gearbox that can very efficiently transmit power received from the conveyor motor to the conveyor, thus reducing the demand on the electrical system. As a result, the electrical system is capable of also powering a second electric motor that drives the spreader. Due to the improved efficiency of the conveyor belt system, increased conveying and spreading speed are possible as well as independent control over the operating speeds of the conveyor and spreader.

4 Claims, 2 Drawing Sheets

ELECTRIC HOPPER-SPREADER

PRIORITY CLAIM

The present application is a continuation of and claims priority under 35 U.S.C. §120 from U.S. patent application Ser. No. 11/425,267 filed Jun. 20, 2006, which claims priority under 35 U.S.C. §120 from U.S. patent application Ser. No. 10/729,792, filed Dec. 5, 2003, now U.S. Pat. No. 7,066,413.

BACKGROUND OF THE INVENTION

1. Field of Invention

The present invention relates to conveyor drive spreaders and, more specifically, to spreaders having a spinner and conveyor powered by separate motors.

2. Description of Prior Art

Conventional drive systems for a material spreading system on a vehicle, such as a hopper spreader, include an auxiliary source for powering both the conveyor drive system and the associated spreading spinner system. The auxiliary source may be a separate internal combustion engine, a hydraulic system with pump, valves and reservoir powered by the truck's engine, or an electric motor that is powered by the electrical system of the vehicle. Electrically powered spreaders are advantageous because they eliminate the need for a separate high maintenance auxiliary engine to power the spreader or the expense of attaching a separate hydraulic system to power the spreader hydraulically.

Conventional electrically powered spreaders were developed from engine-driven or truck-powered hydraulic spreaders. As auxiliary engine driven spreaders and hydraulically powered spreaders had an abundance of power, the low efficiency of the spreader's gear drive system did not affect the operational performance of these two types of spreaders. These spreaders could move the conveyor fast enough to spread effectively at faster speeds of up to 30 MPH that are required when operating this type of spreader.

When the electric spreader was developed, the low efficiency (30%) conveyor drive system of the hydraulic and engine drive spreaders resulted in a conveyor that ran very slow on the minimal amount of truck amperage that was available. The conveyor of the conventional electric spreader does not run fast enough to unload a sufficient amount of material at the higher speeds required in many spreading applications. These slow, electric spreaders are known as "walking speed" spreaders, and cannot be used in faster applications that a separate engine or hydraulic system powered spreaders can handle.

Another disadvantage of the conventional electric spreaders is that the single electric motor draws so much of the truck's amperage that it becomes impractical to power a separate electric motor to run the spinner disc. In hydraulically powered spreaders, independent control of conveyor and spinner was available gives the operator the flexibility in spreading operation to adjust to changing weather, traffic patterns or obstacles. Powering a second electric motor while the first motor is using most of the available amperage drains the battery system on the truck rather quickly. As a result, the conventional electric spreader is generally powered by just one electric motor, and thus is incapable of giving the user independent control over the conveyor and spinner disc.

Objects and Advantages

It is a principal object and advantage of the present invention to improve the speed of the conveyor and spreading systems of an electrically powered spreader.

It is an additional object and advantage of the present invention to provide conveyor and spreading systems for an electrically powered spreader that have independently controlled conveyors and spinners.

It is a further object and advantage of the present invention to provide a more efficient power transfer system in a hopper spreader.

Other objects and advantages of the present invention will in part be obvious, and in part appear hereinafter.

SUMMARY OF THE INVENTION

The present invention comprises a material spreading system for a truck comprising a conveyor and a spinner, each of which is powered by an electric motor that receives power from the vehicle's alternator/battery system. Since both electric motors are powered off the vehicle's battery there is limited amperage available for use by these motors. The conveyor drive system includes a high-efficiency gearbox or chain and sprocket system that translates about 90 to 95 percent of the power it receives into useful output, thus requiring less output from the power source (i.e., the battery) in order to provide predetermined levels of power of the conveyor than less efficient conveyor systems.

Due to the decreased power draw of the conveyor drive, the spinner can be fully powered by its own dedicated electric motor that also draws from the vehicle's battery. Thus, the drive system of the present invention permits faster conveyor and spreader speeds than could be achieved using prior art drive systems, and permits independent control of the spinner and conveyor for more precisely controlled spreading of the hopper contents.

DETAILED DESCRIPTION

Figure 1:
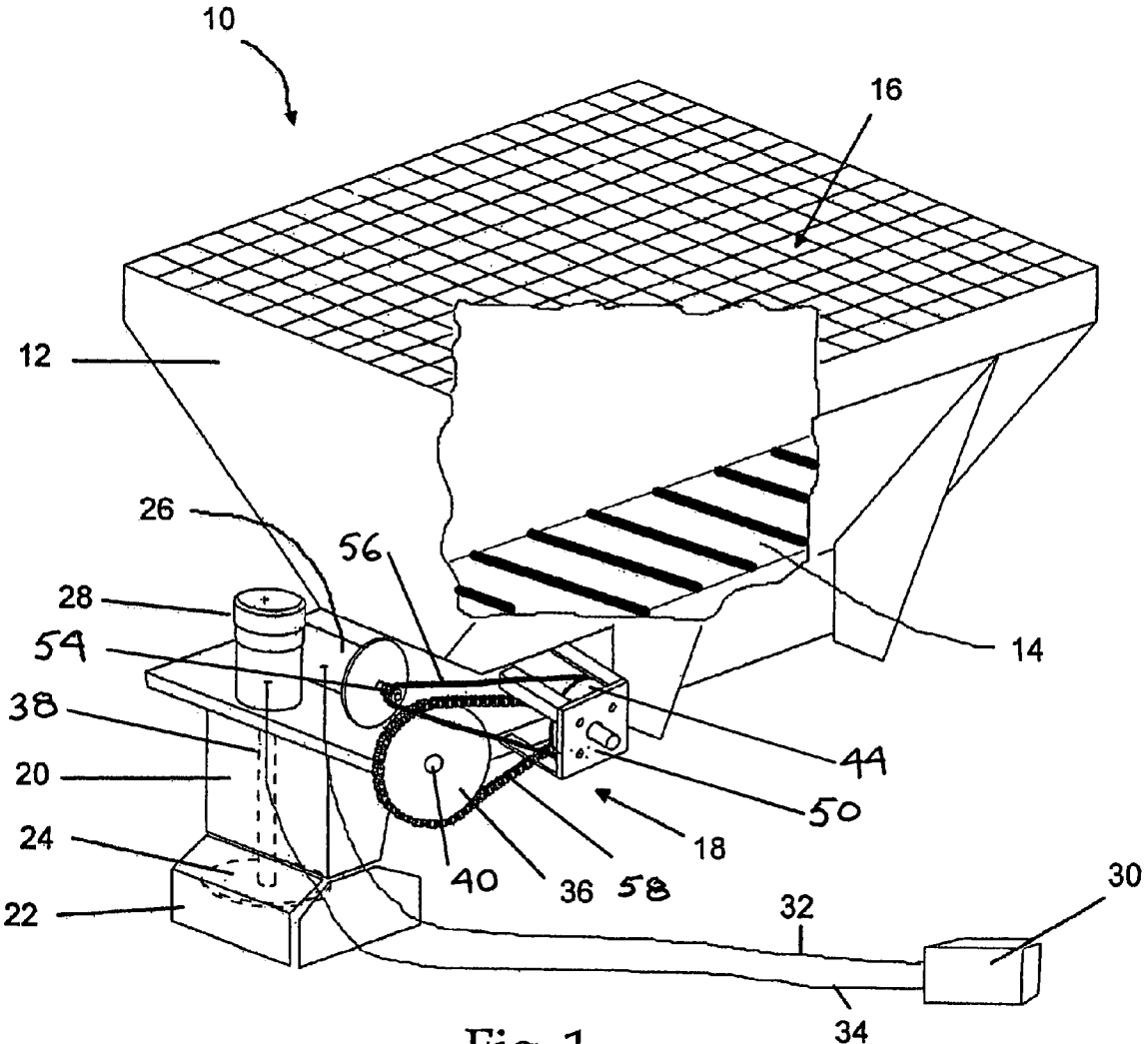
FIG. 1 is a perspective view of a hopper spreader according to the present invention.

Referring now to the figures wherein like numerals refer to like parts throughout, there is seen in FIG. 1 a hopper spreader 10 according to the present invention that can be placed in the bed of a pick-up truck or similar vehicle and used to spread materials, such as road salt, rearwardly from the vehicle. Hopper spreader 10 comprises a hopper 12 having a horizontally oriented bottom conveyor 14, such as a conveyor chain or belt, positioned in the hopper cavity 16 and driven by a conveyor drive system 18, a vertical spreader housing 20 communicating with the discharge end of hopper 12 and having a skirt 22, a spinner 24 positioned inside skirt 22 of housing 20, and two separate electric motors, conveyor motor 26 and spinner motor 28, interconnected to conveyor drive system 18 and spinner 24, respectively. Conveyor motor 26 and spinner motor 28 are both powered by the engine electrical system 30 associated with the battery of the vehicle, by leads 32 and 34, respectively.

The hopper-spreader shown in FIG. 1 is particularly well suited for portable use in the bed of a pickup truck. The hopper 16 is positioned in the truck bed, with the spreader housing 20 hanging over the end of the bed with spinner shaft 38 extending vertically.

Figure 2:
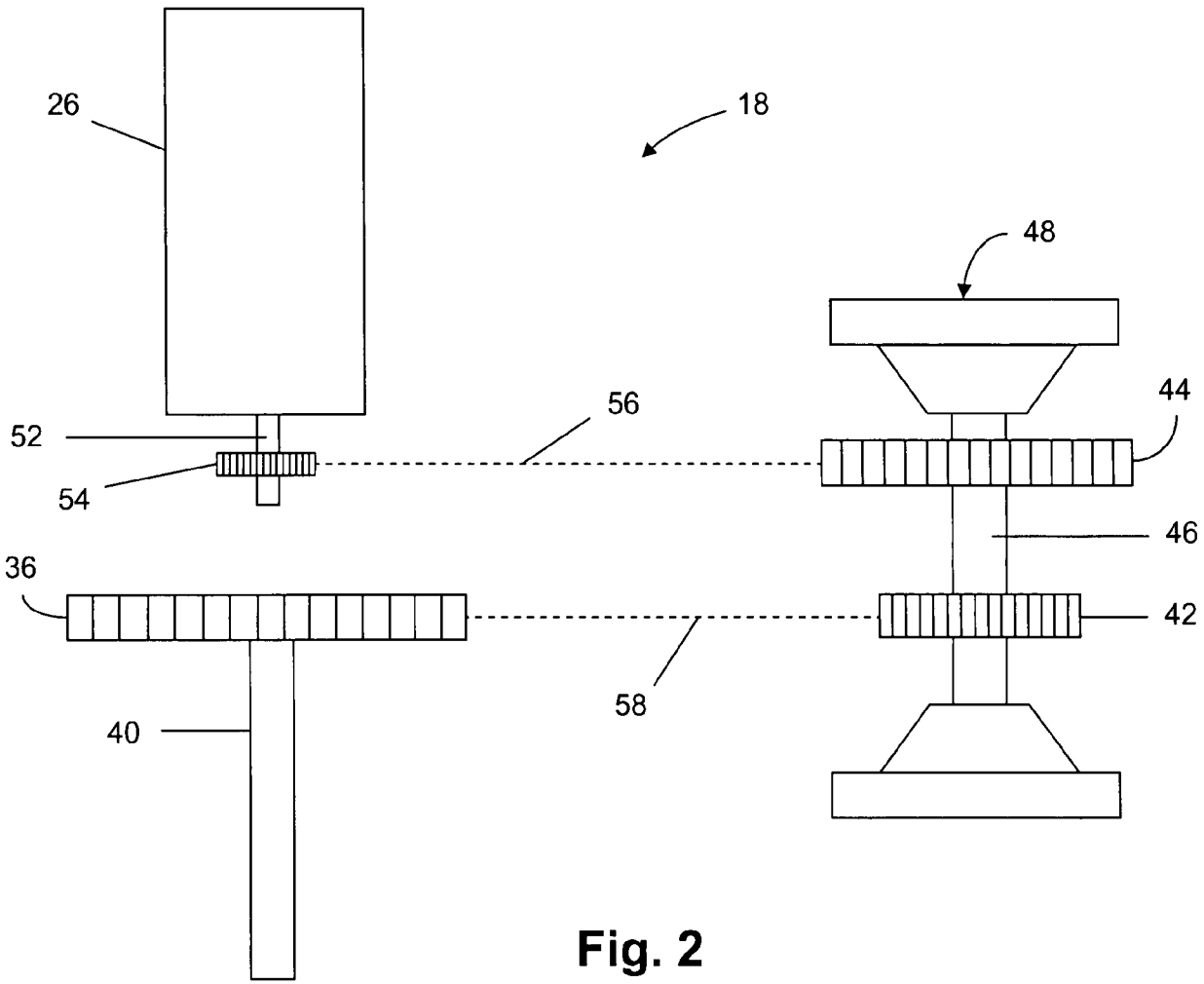
FIG. 2 is a detailed schematic view of the power transmission between the conveyor motor and the conveyor drive shaft shown in FIG. 1.

FIG. 2 is a detailed view of the preferred conveyor drive system 18 as seen in FIG. 1, comprising of a chain and sprocket arrangement 36 that operatively connects the conveyor drive shaft 40 to the conveyor motor 26, via a pair of sprockets 42, 44 on a jack shaft 46 supported in bearings 48. Equivalent low friction circular elements with associated endless loops can be employed. The bearings with jack shaft and sprockets are preferably mounted in a bracket 50 that is rigidly attached at any convenient location on the exterior of the hopper 12. The conveyor drive shaft 40 is horizontally oriented and extends in parallel to the output shaft 52 of conveyor motor 26. In FIG. 2 the conveyor drive shaft 40 is shown facing away from conveyor motor 26 for clarity, but it should be appreciated that as shown in FIG. 1 the conveyor shaft 40 is operatively associated with the conveyor chain or belt 14 at a position substantially above the spreader housing 20, and below the conveyor motor 26, where an end portion of the conveyor chain or belt deposits conveyed material into the spreader housing.

The high efficiency is associated with the speed reduction achieved from the diameter difference between the small sprocket 54 on the motor shaft 52 and the large sprocket 36 on the conveyor shaft 40. Small source or motor sprocket 54 is connected via a first chain 56 to the first speed reducing (larger) sprocket 44, carried on and establishing the rotation speed of the jack shaft 46. A secondary, multiplying speed reduction is achieved between the smaller transfer sprocket 42 on the jack shaft connected by second chain 58 to the larger speed reducing final or conveyor sprocket 36. Source sprocket 54, first speed reducing sprocket 44, transfer sprocket 42 and second speed reducing sprocket 36 are arranged on parallel axes, as shown in FIG. 1.

The chain and sprocket driver with dual speed reducing sprockets transmits a high percentage of the power received from conveyor motor 26 into useful output, thus requiring less output from the vehicular electrical system (e.g., the battery).

Due to the high efficiency of conveyor drive system 18, the ampere draw of conveyor motor 26 is significantly reduced, thereby enabling faster operating speeds. Because of the decrease in current required by conveyor motor 26, the vehicular electrical system also has sufficient current available to power separate spinner motor 28. As a result, conveyor motor 26 and spinner motor 28 can be controlled independently, thereby giving an operator more control over spreading speeds in variable conditions.

The invention claimed is:

1. A spreading system for a pickup truck vehicle having a vehicle electrical system, said spreading system comprising:

a hopper having a discharge end;

a spreader having a housing in communication with the discharge end of said hopper;

a conveyor positioned within said hopper and driven by a rotatable conveyor drive shaft connected to the conveyor;

a first electric motor interconnected to said vehicle electrical system and having a rotatable motor output drive shaft offset from and parallel to said conveyor drive shaft;

a transmission coupled to the output drive shaft of said first electric motor including a first, relatively smaller diameter circular member on the motor drive shaft operatively connected to rotate a second, relatively larger diameter circular member on the conveyor drive shaft for translating power at reduced speed of rotation from said electric motor output drive shaft to said conveyor drive shaft;

a second electric motor interconnected to said vehicle electrical system and coupled to said spreader;

wherein the transmission includes a plurality of additional circular members of differing diameters operatively interposed between the first and second circular members to multiply a speed reduction between the rotation of the motor output drive shaft and the rotation of the conveyor drive shaft.

2. The spreading system of claim 1, wherein each of the first and second circular members is operatively connected to one of said additional circular members, by an endless loop.

3. The spreading system of claim 2, wherein the circular members are sprockets and the endless loops are chains.

4. The spreading system of claim 1, wherein the transmission comprises:

a jack shaft mounted for rotation in bearings that are offset from the motor and conveyor shafts;

a first sprocket on the jack shaft, having a larger diameter than the sprocket on the motor shaft;

a second sprocket on the jack shaft, having a smaller diameter than that of the first sprocket on the jack shaft and of the conveyor shaft sprocket; and a first endless loop between the motor sprocket and the first sprocket on the jack shaft and a second endless loop between the second sprocket on the jack shaft and the conveyor shaft sprocket.

* * * * *

UNITED STATES PATENT AND TRADEMARK OFFICE

CERTIFICATE OF CORRECTION

PATENT NO. : 7,748,652 B2
APPLICATION NO. : 12/002266
DATED : July 6, 2010
INVENTOR(S) : Musso et al.

It is certified that error appears in the above-identified patent and that said Letters Patent is hereby corrected as shown below:

Title page,
Item [63], Related U.S. Application Data, after

"Continuation of application No. 11/425,267, filed on Jun. 20, 2006"

insert

--, which is a continuation of application No. 10/729,792, filed on December 5, 2003, now Pat. No. 7,066,413--.

Signed and Sealed this

Second Day of November, 2010

David J. Kappos

David J. Kappos
*Director of the United States Patent and Trademark Office*